US006260262B1

(12) United States Patent
Torii

(10) Patent No.: US 6,260,262 B1
(45) Date of Patent: Jul. 17, 2001

(54) WIRE PRESS-CONNECTING APPARATUS

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/502,798

(22) Filed: Feb. 11, 2000

Related U.S. Application Data

(62) Division of application No. 09/369,142, filed on Aug. 5, 1999.

(30) Foreign Application Priority Data

Aug. 5, 1998 (JP) ..... 10-221692

(51) Int. Cl.[7] ..... H01R 43/04

(52) U.S. Cl. ..... 29/753; 29/751; 29/33 M; 29/755; 29/854; 29/861; 29/862; 29/863; 72/442; 72/453.07

(58) Field of Search ..... 29/753, 751, 334, 29/755, 861, 862, 863, 857; 72/442, 453.07

(56) References Cited

U.S. PATENT DOCUMENTS 5,575,061 * 11/1996 Tsuji et al. ..... 29/753

* cited by examiner

*Primary Examiner*—Lee Young
*Assistant Examiner*—Rick Kiltae Chang
(74) *Attorney, Agent, or Firm*—Sughrue, Mion, Zinn Macpeak & Seas, PLLC

(57) ABSTRACT

A press-connecting punch (3) for press-fitting the sheathed wire (40) into a slot between each pair of opposed press-connecting blades (33) of the press-connecting terminal (30), supported on a bed (1), is moved downward to act on the sheathed wire (40) prior to the downward movement of a clamping punch (13) for pressing a wire holding portion (35) of the press-connecting terminal (30) into clamping engagement with a sheath (41) of the sheathed wire (40).

1 Claim, 4 Drawing Sheets

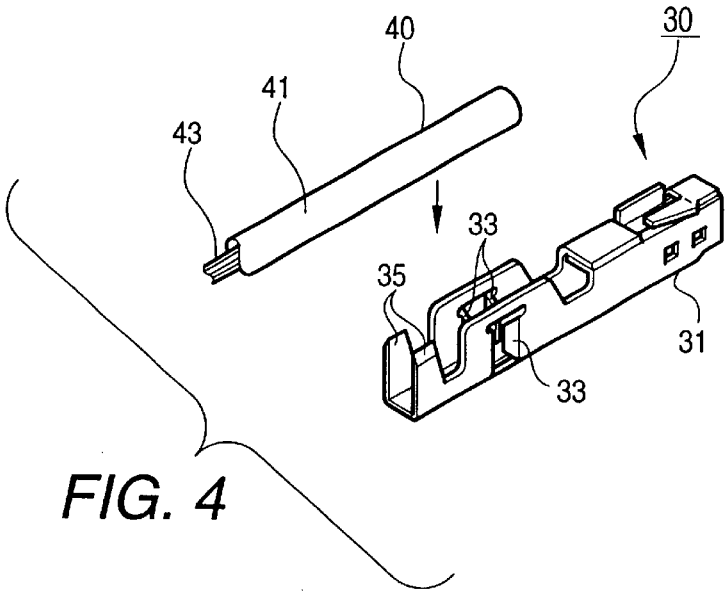
FIG. 4
FIG. 5
PRIOR ART
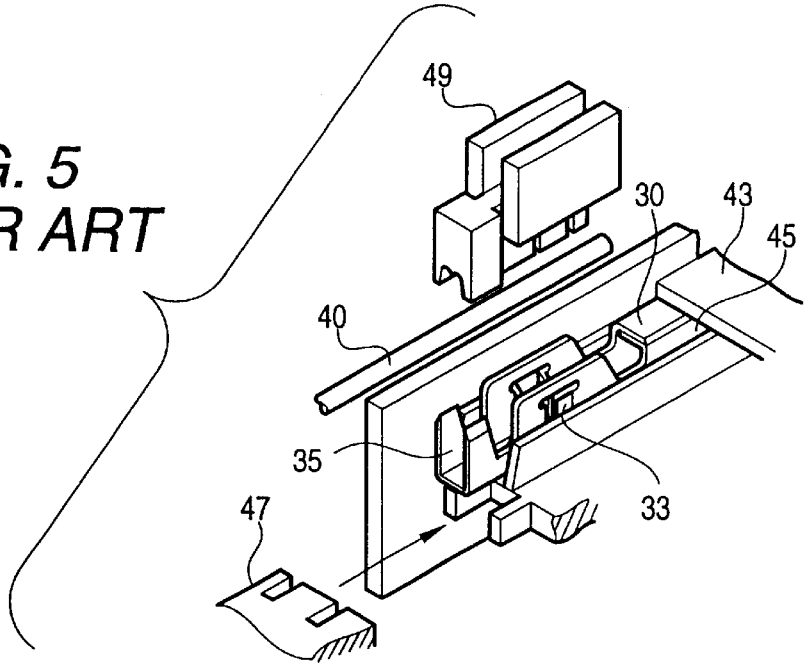

WIRE PRESS-CONNECTING APPARATUS

This is a divisional of application Ser. No. 09/369,142 filed Aug. 5, 1999, the disclosure of which is incorporated herein by reference.

BACKGROUND OF THE INVENTION

1. Field of the Invention

The present invention relates to a method of connecting a wire to a press-connecting terminal and a wire press-connecting apparatus. More particularly, the present invention relates to an improved method of connecting a wire to a press-connecting terminal and an improved wire press-connecting apparatus, in which the cutting (or shaving) and severance of a conductor in the wire are prevented when the sheathed wire is press-fitted into a slot (or gap) between press-connecting blades of the press-connecting terminal.

The present application is based on Japanese Patent Application No. Hei. 10-221692, which is incorporated herein by reference.

2. Description of the Related Art

When connecting a sheathed wire to a press-connecting terminal, a conductor in the wire can be connected to the terminal without the need for peeling a sheath from an end portion of the sheathed wire, and therefore the press-connecting terminal is suited for an automated operation, and also can reduce the fabrication cost. The press-connecting terminal 30, disclosed for example in Unexamined Japanese Patent Publication No. 10-92480, will now be described with reference to FIG. 4. This press-connecting terminal 30 is formed by bending a single metal sheet, and includes a contact 31, formed at one longitudinal end portion thereof for electrical connection to a mating metal terminal (not shown), pairs of opposed press-connecting blades 33, which are formed by inwardly bending parts of opposite side walls of a cross-sectionally U-shaped terminal body, and can cut a sheath 41 of the sheathed wire 40 to come into electrical contact with a conductor 43 of the wire upon press-fitting of the sheathed wire 40 into the slot between the press-connecting blades 33, and a wire holding portion 35 which is formed at the other longitudinal end portion of the terminal in adjacent relation to the press-connecting blades 33, and has its opposite side walls which can be bent inwardly to clamp the sheath 41, thereby fixedly connecting the sheathed wire 40 to the terminal.

In the above publication, as shown in FIG. 5, the press-connecting terminal 30, to which the wire is not yet connected, is beforehand mounted in each of juxtaposed terminal receiving chambers 45 in a connector housing 43, and then the sheathed wire 40 is disposed above the press-connecting terminal 30. In this condition, a lower die (anvil) 47 is inserted into a lower position corresponding to the wire holding portion 35, and a mounting jig (punch) 49 is moved downward from an upper position. As a result, the sheathed wire 40 is press-fitted into the slot between each pair of press-connecting blades 33, and at the same time the wire holding portion 35 is pressed to clamp or hold the sheath 41, thereby electrically connecting the sheathed wire 40 to the press-connecting terminal 30.

Thus, the mounting jig 49 is usually provided with a press-connecting punch for press-fitting the wire, and a clamping punch for fixing the wire, and simultaneously with the press-fitting of the sheathed wire 40 into the slot between each pair of press-connecting blades 33, the pressing of the wire holding portion 35 is effected.

With the use of such a mounting jig 49, the wire connecting-process in the automated operation was simplified, and also the time, required for the connecting operation, was reduced, so that the sheathed wire 40 could be efficiently connected to the press-connecting terminal 30.

However, in the wire connecting method and the wire press-connecting apparatus, using the above mounting jig, the wire holding portion 35, performing the function of strain relief, is pressed (as shown in FIGS. 7A and 7B) simultaneously with the press-fitting of the sheathed wire 40 into the slot between each pair of press-connecting blades 33 as shown in FIGS. 6A and 6B, and therefore the following difficulty has been encountered. When the wire 40 is press-fitted into the slot between the opposed press-connecting blades 33, the opposite (right and left) side walls are slightly deformed to be spread out (moved away from each other) as shown in FIG. 6B. On the other hand, bending forces, pressing the wire holding portion 35, are exerted inwardly, that is, in directions opposite respectively to the direction of the above outwardly-deforming forces, and prevent the opposite (right and left) side walls from being spread out. Particularly, those press-connecting blades 33, disposed close to this portion, is much affected by these bending forces, and therefore the conductor of the sheathed wire, press-fitted into the slot between these press-connecting blades, is liable to be severed. Namely, the opposed press-connecting blades are not smoothly spread out in accordance with the press-fitting of the sheathed wire, and in this condition the sheathed wire is almost forcibly press-fitted into the slot between the press-connecting blades.

SUMMARY OF THE INVENTION

With the above problem in view, it is an object of the present invention to provide a method of connecting a wire to a press-connecting terminal and a wire press-connecting apparatus which overcome disadvantages, such as the cutting (or shaving) and severance of a conductor in the sheathed wire, which can be encountered when the sheathed wire is press-fitted into a slot between press-connecting blades of the press-connecting terminal, and in which the pressure of contact of the press-connecting blades with the conductor of the press-fitted wire is increased, thereby enhancing the reliability of electrical connection therebetween.

According to the first aspect of the present invention, there is provided a method of connecting a wire to a press-connecting terminal. In the method, a sheathed wire is press-fitted into a slot between opposed press-connecting blades of a press-connecting terminal while cutting a sheath of the sheathed wire, thereby electrically connecting a conductor of the sheathed wire to the press-connecting blades, and a wire holding portion formed on the press-connecting terminal in adjacent relation to the press-connecting blades is pressed to clamp the sheath of the sheathed wire, thereby fixedly connecting the sheathed wire to the press-connecting terminal. Especially, in the method, the timing for performing the press-fitting step is different from the timing for performing the pressing step.

In this method, in order that the timing for performing the sheathed wire press-fitting step can be different from the timing for performing the wire holding portion-pressing step, the press-fitting of the sheathed wire is effected, for example, prior to the pressing of the wire holding portion. By doing so, a factor in the prevention of deformation of the press-connecting blades is not encountered when the sheathed wire is press-fitted into the slot between the press-connecting blades, and therefore the opposed press-connecting blades are easily spread out in accordance with the press-fitting of the sheathed wire.

According to the second aspect of the present invention, there is provided a method of connecting a wire to a press-connecting terminal which comprises the following steps. First, a press-connecting terminal including opposed press-connecting blades, between which a slot is formed, and a wire holding portion formed in adjacent relation to the press-connecting blades; and a sheathed wire including a conductor and a sheath that covers the conductor are provided. Afterwards, the sheathed wire is press-fitted into the slot between opposed press-connecting blades while cutting the sheath of the sheathed wire, so that the conductor of the sheathed wire is electrically connected to the press-connecting blades, and the wire holding portion is pressed to clamp the sheath of the sheathed wire, so that the sheathed wire is fixedly connected to the press-connecting terminal. Especially, the press-fitting step is performed separately with the pressing step.

According to the third aspect of the present invention, there is provided a wire press-connecting apparatus which comprises a bed, which supports a press-connecting terminal from a lower side, a press-connecting punch movable downward from an upper position relative to the press-connecting terminal supported on the bed so as to press-fit a sheathed wire into a slot between opposed press-connecting blades of the press-connecting terminal, and a clamping punch movable downward from an upper position relative to the press-connecting terminal supported on the bed so as to press a wire holding portion of the press-connecting terminal to clamp a sheath of the sheathed wire, the wire holding portion being formed on the press-connecting terminal in adjacent relation to the press-connecting blades, wherein the press-connecting punch is moved downward prior to a downward movement of the clamping punch, and the clamping punch is moved downward, with the sheathed wire kept press-fitted in the slot between the press-connecting blades, so as to press the wire holding portion to clamp the sheath of the sheathed wire.

In this construction, prior to the downward movement of the clamping punch, the press-connecting punch is moved downward to press-fit the sheathed wire into the slot between the opposed press-connecting blades. At this time, the opposed press-connecting blades are slightly deformed to be spread out in accordance with the press-fitting force, and therefore the sheathed wire can be satisfactorily fitted deep into the slot between the press-connecting blades without causing the cutting (or shaving) of the conductor of the wire.

The clamping punch presses the wire holding portion for clamping purposes after the press-fitting of the sheathed wire, and therefore inwardly-bending forces, produced in accordance with the pressing of the wire holding portion, act on the press-connecting blades to enhance the pressure of contact of the press-connecting blades with the conductor. As a result, the opposed press-connecting blades of the press-connecting terminal, once spread out, are returned to their initial condition, so that the contact reliability is enhanced.

The clamping punch presses the wire holding portion, with the sheathed wire kept press-fitted in the slot between the press-connecting blades. Therefore, the clamping punch can satisfactorily press the wire holding portion into clamping engagement with the sheathed wire while the press-connecting punch prevents the sheathed wire from being raised.

BRIEF DESCRIPTION OF THE DRAWINGS

FIG. 2A shows a condition before a clamping punch is operated, and FIG. 2B shows a condition after the clamping punch is operated;

FIG. 3A shows a condition in which a press-connecting punch is operated, and FIG. 3B shows a condition in which the clamping punch is operated;

FIG. 4 is a perspective view showing the appearance of a press-connecting terminal;

FIG. 5 is a view showing the related press-connecting method;

DETAILED DESCRIPTION OF THE PREFERRED EMBODIMENT

A method of connecting a wire to a press-connecting terminal according to the present invention, as well as a preferred embodiment of a wire press-connecting apparatus of the present invention, will now be described in detail with reference to FIGS. 1–4.

Figure 1:
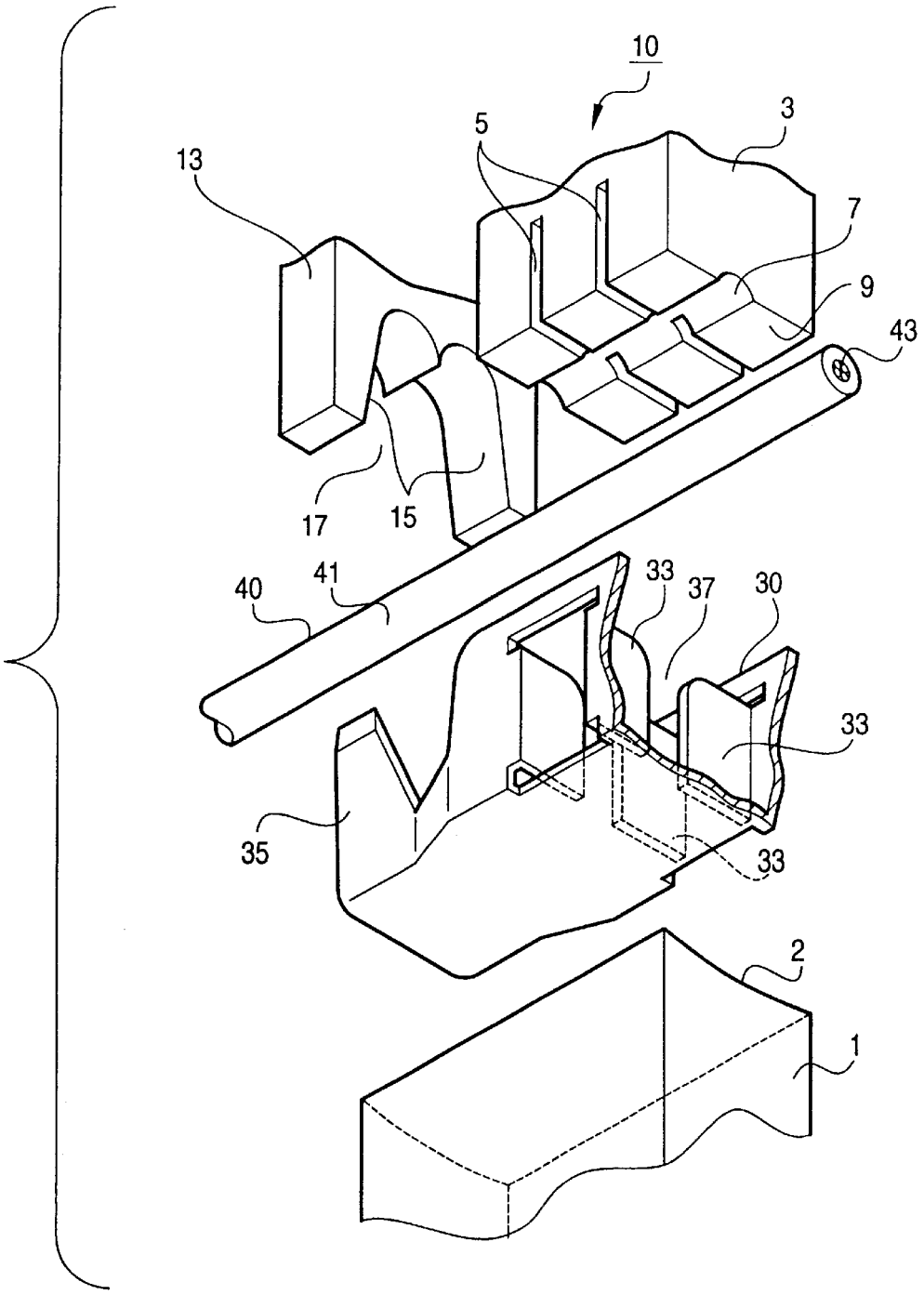
FIG. 1 is a view showing the construction of a wire press-connecting apparatus of the present invention.

FIG. 1 is an exploded, perspective view of one preferred embodiment of a wire press-connecting apparatus of the present invention.

The method of connecting the wire to the press-connecting terminal will also be described together with the wire press-connecting apparatus of this embodiment. Those members and portions identical to those of the related construction in the background section will be designated by identical reference numerals, respectively, and explanation thereof will be omitted.

In FIG. 1, the wire press-connecting apparatus 10 comprises a bed 1 for supporting the press-connecting terminal 30 from the lower side, a press-connecting punch 3, and a clamping punch 13, the two punches 3 and 13 being movable downward relative to the press-connecting terminal 30 from an upper position so as to connect the sheathed wire 40 to the press-connecting terminal 30.

The bed 1 comprises a base (lower die) on which the press-connecting terminal 30 can be placed, and an upper surface 2 of the bed 1 generally conforms in shape to the lower surface of the press-connecting terminal 30, and at least that portion of this upper surface 2, corresponding to a wire holding portion 35 of the press-connecting terminal 30, is slightly curved so as to provide a good clamping shape of the wire holding portion 35. In this embodiment, the bed 1 is fixed, and has such a size that press-connecting blades 33 and the wire holding portion 35 of the press-connecting terminal 30 can be placed thereon.

However, the bed 1 may have such a construction as to support the whole of the press-connecting terminal 30 including a contact 31 (see FIG. 4). There may be used an arrangement in which the bed corresponds in size to the wire holding portion, and is movable into a lower position corresponding to the wire holding portion when the press-connecting terminal is kept received in a terminal receiving chamber in a connector housing (not shown).

As in the related construction, the press-connecting terminal 30 is formed by bending a single metal sheet, and parts of opposite (right and left) side walls of a cross-sectionally U-shaped terminal body are bent inwardly to form a plurality of pairs of opposed press-connecting blades 33. Each pair of opposed press-connecting blades 33 form a slot 37 therebetween, and when the sheathed wire 40 is press-fitted into the slot 37, the press-connecting blades 33 cut a sheath 41 of this wire.

The press-connecting terminal 30 also includes the wire holding portion 35 which is formed at a rear end portion thereof in adjacent relation to the press-connecting blades 33, and has its opposite (right and left) side walls which are upstanding, and can be bent.

The press-connecting punch 3 comprises an upper die which can be moved downward from the upper position relative to the press-connecting terminal 30 on the bed 1 so as to press-fit the sheathed wire 40 into the slot 37 between each pair of press-connecting blades 33. The press- connecting punch 3 has a plurality of juxtaposed relief grooves 5 which are formed in a lower surface 9 thereof, and extend upwardly, and correspond respectively to the press-connecting blades 33. When the press-connecting punch 3 is moved downward, the press-connecting blades 33 enter the relief grooves 5, respectively. A pressing recessed portion 7 for contact with the outer peripheral surface of the sheathed wire 40 to press the same is formed in the lower surface 9, and extends in a direction perpendicular to the relief grooves 5.

The clamping punch 13 comprises an upper die which can be moved downward from the upper position relative to the press-connecting terminal 30 on the bed 1 so as to press the wire holding portion 35 into clamping engagement with the sheath 41 of the sheathed wire 40. The clamping punch 13 includes guide walls 15 for gradually bending the wire holding portion 35 inwardly as the clamping punch 13 moves downward, and a mountain-shaped recessed portion 17 for pressing the wire holding portion 35 onto the sheath 41.

A feature of this embodiment is that the press-connecting punch 3 and the clamping punch 13 are provided for movement independently of each other, and in this embodiment, the press-connecting punch 3 is moved downward prior to the downward movement of the clamping punch 3.

The method of connecting the wire to the press-connecting terminal, as well as its operation, will now be described with reference to FIGS. 2 and 3.

Figure 2A:
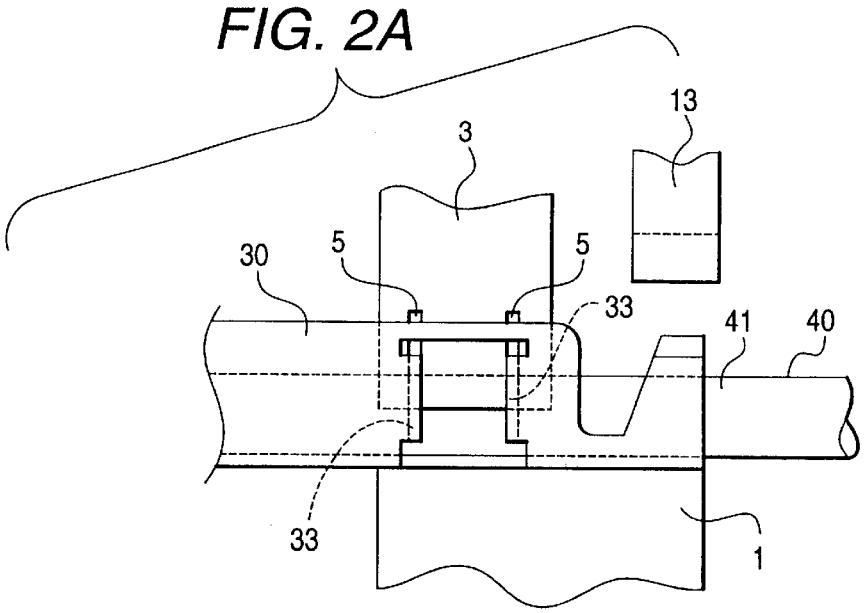
FIGS. 2A and 2B show the steps of a wire press-connecting method performed by the press-connecting apparatus of FIG. 1, and more specifically.

First, the sheathed wire 40 is disposed above the press-connecting terminal 30 supported on the bed 1, and in this condition the press-connecting punch 3 in the wire press-connecting apparatus 10 is moved downward prior to the downward movement of the clamping punch 13, thereby press-fitting the sheathed wire 40 deep into the slots, as shown in FIG. 2A. As a result, the sheath 41 of the sheathed wire 40 is cut by the press-connecting blades 33, so that a conductor 43 of this wire is brought into electrical contact with the press-connecting blades 33.

Figure 3A:
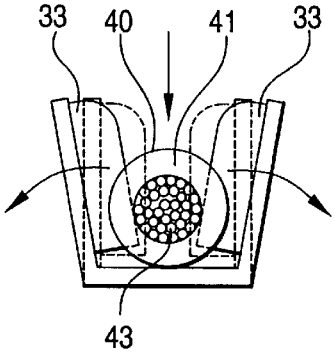
FIGS. 3A and 3B show the condition of press-connecting blades corresponding to the steps of FIGS. 2A and 2B, and more specifically.
Figure 3B:
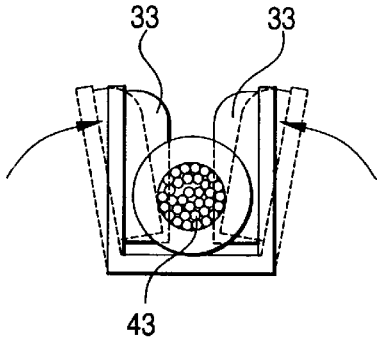
Figure 6A:
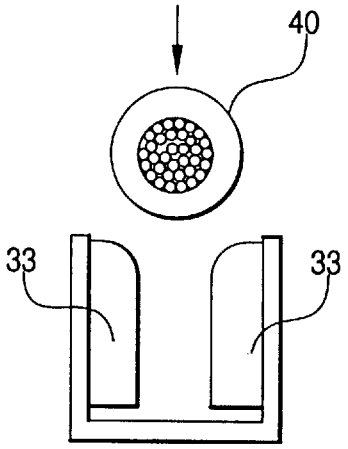
FIG. 6A PRIOR ART
FIGS. 6A and 6B show the condition of press-connecting blades in the related press-connecting method.
Figure 6B:
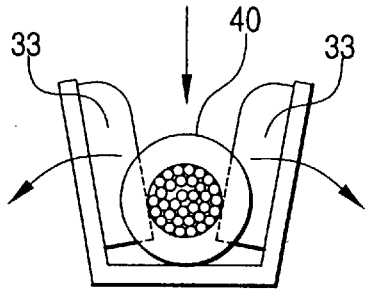
FIG. 6B PRIOR ART
Figure 7A:
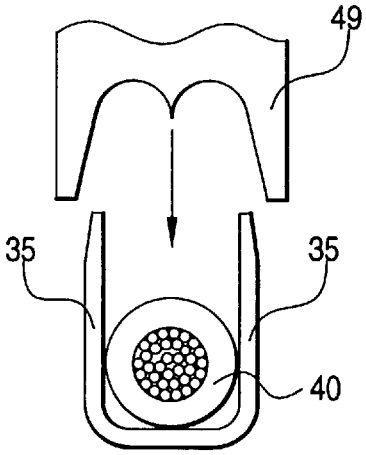
FIG. 7A PRIOR ART
FIGS. 7A and 7B show the condition of a wire holding portion in the related press-connecting method.
Figure 7B:
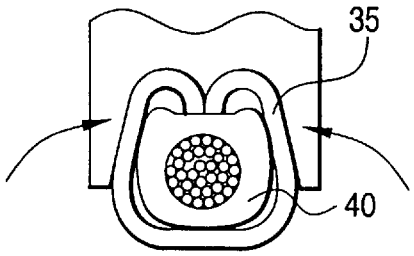
FIG. 7B PRIOR ART

When the press-connecting punch 3 is thus moved downward, the right and left side walls, having the press-connecting blades 33, are slightly deformed to be spread out in accordance with the press-fitting of the sheathed wire 40, as shown in FIG. 3A. Therefore, the press-connecting blades 33 facilitate the entry of the sheathed wire 40 into the slots, and also have a sufficient resilient force to cut the sheath 41. Therefore, the cutting (or shaving) and severance of the conductor 43 are prevented, and at the same time the good electrical contact of the conductor 43 with the press-connecting blades 33 is achieved.

Figure 2B:
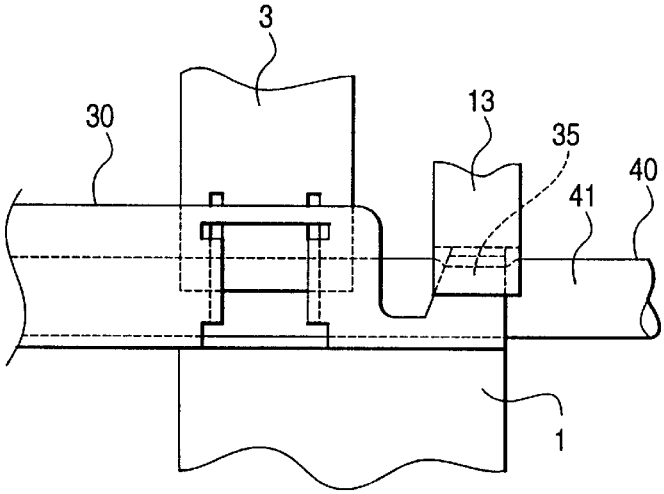

Then, the clamping punch 13 in the wire press-connecting apparatus 10 is moved downward while the press-connecting punch 13 is kept stationary, with the sheathed wire 40 press-fitted in the slots, as shown in FIG. 2B, and as a result the surfaces of the guide walls 15 are brought into sliding contact with distal end portions of the wire holding portion 35, so that the wire holding portion 35 is gradually bent inwardly in a generally constricted manner to clamp the sheath 41. As a result, the press-connecting terminal 30 is fixedly connected to the sheathed wire 40 firmly.

When the clamping punch 13 is thus, moved downward, inwardly-bending forces, exerted on the wire holding portion 35, act on each pair of the opposed press-connecting blades 33 so as to move the press-connecting blades 33 toward each other. As a result, the press-connecting blades 33, which have been slightly spread out upon press-fitting of the sheathed wire 40, are returned to their initial condition, so that the pressure of contact of the press-connecting blades 33 with the conductor 43 is increased. Therefore, the reliability of contact of the press-connecting blades 33 of the press-connecting terminal 30 is enhanced. And besides, when the clamping punch 13 is moved downward, the press-connecting punch 3, held in its lowered position where the sheathed wire 40 is press-fitted in the slots, prevents the sheathed wire 40 from being raised, and therefore the clamping punch 13 can clamp the sheathed wire 40 satisfactorily.

In the above method of connecting the wire to the press-connecting terminal, for description purposes, the clamping punch is moved downward after the press-connecting punch is completely moved downward. However, the present invention is not limited to this embodiment, and it is only necessary that the timing when the sheathed wire is press-fitted into the slot between each pair of opposed press-connecting blades should be slightly different from the timing for pressing the wire holding portion for clamping purposes, and therefore this construction may be such that the two punches are moved downward generally simultaneously.

In the wire connecting method of the above embodiment, although the press-fitting step of press-fitting the sheathed wire into the slot between each pair of opposed press-connecting blades is carried out prior to the clamping step of clamping the sheathed wire by the wire holding portion, the present invention is not limited to such an arrangement in so far as the opposed press-connecting blades can be satisfactorily spread out at the time of performing the press-fitting step. The press-fitting operation may be carried out after the clamping operation. In this case, however, the recovery of the contact pressure of the press-connecting blades, achieved in accordance with the pressing of the wire holding portion, can not be expected.

In the method of connecting the wire to the press-connecting terminal and the wire press-connecting apparatus according to the present invention, the timing for performing the step of press-fitting the sheathed wire into the slot between the opposed press-connecting blades is different from the timing for performing the step of pressing the wire holding portion into clamping engagement with the sheath of the sheathed wire. Therefore, when the sheathed wire is press-fitted into the slot between the press-connecting blades, the opposed press-connecting blades are easily spread out in such a manner that the force to prevent the deformation of the press-connecting blades does not act on the press-connecting blades. This overcomes the disadvantages, such as the cutting (or shaving) and severance of the conductor, encountered when the sheathed wire is press-fitted. And besides, after the press-fitting of the sheathed wire into the slot between the press-connecting blades, the deforming force, produced when the wire holding portion is pressed, acts on the press-connecting blades to increase the pressure of contact of the press-connecting blades with the conductor, thus enhancing the reliability of contact of the press-connecting blades with the conductor. Furthermore, the press-connecting punch, moved downward prior to the downward movement of the clamping punch, prevents the sheathed wire from being raised, and therefore the clamping punch can satisfactorily press the wire holding portion into clamping engagement with the sheath.

What is claimed is:

1. A wire press-connecting apparatus, comprising:

a bed which supports a press-connecting terminal;

a press-connecting punch located above said bed and being moveable in a downward direction from an upper position relative to the press-connecting terminal supported on the bed so as to press-fit a sheathed wire into a slot between opposed press-connecting blades of the press-connecting terminal and;

a clamping punch located above said bed and being movable in said downward direction from an upper position relative to the press-connecting terminal supported on the bed so as to press a wire holding portion of the press-connecting terminal to clamp a sheath of the sheathed wire, the wire holding portion being formed on the press-connecting terminal in adjacent relation to the press-connecting blades, wherein the clamping punch is moveable independently of the press-connecting punch and wherein the press-connecting punch is initially moved in said downward direction, and thereafter the clamping punch is moved in said downward direction, with the sheathed wire kept press-fitted in the slot between the press-connecting blades, so as to press the wire holding portion to clamp the sheath of the sheathed wire.

* * * * *